US005290224A

United States Patent [19]

Boix Jaen

[11] Patent Number: 5,290,224

[45] Date of Patent: Mar. 1, 1994

[54] CARDBOARD BOX ASSEMBLY MACHINES

[75] Inventor: Jose Boix Jaen, Elche, Spain

[73] Assignee: Boix Maquinaria, S.A., Eleche, Spain

[21] Appl. No.: 876,773

[22] Filed: Apr. 30, 1992

[30] Foreign Application Priority Data

Jul. 5, 1991 [ES] Spain ..... 9101580
Jul. 10, 1991 [ES] Spain ..... 9102194

[51] Int. Cl.[5] ..... B31B 1/52; B65H 3/08

[52] U.S. Cl. ..... 493/183; 271/102; 271/107

[58] Field of Search ..... 271/5, 14, 11, 144, 271/99, 102, 107; 493/183, 184, 498, 475

[56] References Cited

U.S. PATENT DOCUMENTS 4,285,682 8/1981 Moss ..... 493/183
4,732,376 3/1988 Umezawa ..... 271/14
4,857,038 8/1989 Tacchini ..... 493/183

*Primary Examiner*—Jack Lavinder
*Attorney, Agent, or Firm*—Darby & Darby

[57] ABSTRACT

They consist of an adjustable mechanism to feed the cardboard sheets with which boxes are formed and of a lifting device of the laps that said cardboard sheets have.

The purpose of the adjustable mechanism for the feeding of the sheets is to adjust the position of the vacuum suction pads for the feeding of the cardboard sheets, whatever the dimensions thereof are, without the need to stop the assembly machine. For this reason, the groups of suction pads have their supports resting on two split contrary thread spindles, in such a way that with a single manual control and connecting both spindles by chain transmission displacement thereof is obtained all along the guide bars, thus establishing the work position of said suction pads.

The purpose of the lap lifting device is to automatically effect the lifting of the laps to the predetermined angular position. For this reaon it comprises a strip, tiltable by the action of pneumatic cylinders, which through their action of a shaft, to which the arms of the strip are joined, push the laps to their predetermined position. It comprises a means of approximation or separation in accordance with the format or dimensions of the laps.

4 Claims, 10 Drawing Sheets

CARDBOARD BOX ASSEMBLY MACHINES

OBJECT OF THE INVENTION

The object of the invention refers to some improvements in cardbox box assembly machines that consist of an adjustable mechanism to feed the cardboard sheets with which boxes are formed and of a lifting device of the laps that said cardboard sheets have, with which boxes are formed.

In one case, the purpose thereof is to allow the adjustment of the elements that operate by vacuum, to feed the cardboard sheets, whatever the dimensions thereof are, through a mechanism that permits displacement of such elements, even when the machine is full operation.

In another case, the purpose achieved is to effect automatically the lifting of the laps that form the cardboard sheet to the angular position determining the action of the glueing machines that make it possible to fix said laps to the sides or front ends of the boxes for the assembly thereof.

BACKGROUND OF THE INVENTION

According to the prior art, in cardboard box assembly machines, there is a cardboard sheet feeding mechanism, that comprises a series of vacuum suction elements (suction pads) which by means of an up and down movement, supply the assembly machine with sheets in a unitary manner.

The suction pads of these mechanisms are in a stable position. In order to modify their position, in the event of a change of format or dimensions of the cardboard sheet, it is necessary to stop the machine, so that the operator may have access to the mechanism and make the corrections and adjustment of operation of the suction pads by hand.

Although this operation is known to be simple, it takes up a long time, especially in the cases in which there are many suction pads assembled.

It is also noteworthy the series of mechanical tests and subsequent stopping of the machine to effect the exact adjustment of positioning of the suction pads.

In order to lift the laps that comprise the cardboard sheets, the known technique uses some tongues situated at the passage of the cardboard sheets in the feed path to the machine, whose tongues have a certain incline, in accordance with the type of box to be assembled, In other words, the laps are lifted and subjected to the action of the assembly mold directly.

With this certain difficulties are created regarding the operation of the glueing machines, due to the fact that the laps do not have a constant angulation position.

DESCRIPTION OF THE INVENTION

The invention through the improvements provided to the cardboard box assembly machines tries to solve all those problems.

Therefore, the machine has been provided with an adjustable mechanism of the suction elements (suction pads), that remain in groups, each one of which is located upon a support connected with a corresponding vertical guide, along which it moves, operated by a connecting rod and lever, that give it alternating (up and down) movement, to effect the unitary conveyance of a cardboard sheet, removed from the base of a pile of sheets.

The adjustment system is comprised of two parallel spindles, each one of which comprises two identical sections of contrary thread, and they are connected together by chain transmission. Each section of each spindle has mounted a sliding element that constitutes a support means of the rising and lowering mechanisms of the groups of vacuum suction pads. The two spindles are mounted in a stable situation, with fixed supports, upon the body of the adjuster mechanism.

In parallel with one of the spindles there is a striated shaft, whose ends rest on bearings fixed to the body. A nut moveable by the turning of the spindle is mounted in the spindle and the nut has a radial extension by which it is connected with a hose mounted on the striated shaft, to which it transmits the displaceable movement. This hose receives, in one of its ends, the head of a lever that turns partially at pulses of a conventional alternating mechanism, which acts upon the striated shaft and whose purpose is to transmit up and down movement to the suction pad groups.

In parallel with the other spindle, there are two bars, one above and one below, upon which there is a sliding piece by means of rotation of the spindle, guided by the bars, each one of whose sliding parts is solidly connected to one of the vertical supports, with slipper and vertical linear guide of a vacuum suction pad group, for which purpose, each vertical support is connected with the sliding piece mounted in each contrary thread area of the spindle, permitting the vertical displacement of each support, in combination with the displacement of each one of the two levers, connected with the first spindle, which transmit the up and down movement to each vacuum suction pad group.

The rotation movement of the spindles is done by hand, by coupling, to one of them a wheel or handle, upon one of the ends thereof, which is provided with a hose existing for this purpose.

In accordance with what is described it is obvious that the approximation or separation of the vacuum suction pads group can be done even when the assembly machine is in motion, since the mechanisms that operate it move independent of the adjustment displacement. This adjustment allows coupling of the suction pad groups to different box formats.

On the other hand, this mechanism is also designed to replace conventional feed mechanisms in different types of machines, in which the cited feeding is done by vacuum suction pads.

As to the lap lifting device, it is comprised of a strip, tiltable by the action of two pneumatic cylinders, which through their action on a shaft, to which the arms of the strip are joined, push the laps until the position of 90°, in other words, perpendicular to the chardboard sheet from which they emerge.

The cited strip serves as a guide to the laps during the longitudinal movement of the cardboard sheet toward the glueing.

The lifting device comprises adjustment means to approach or separate the device, depending on the format and dimensions of the laps.

BRIEF DESCRIPTION OF THE DRAWINGS

The attached drawings show the improvements object of the invention, in different views and details so that the constitution thereof can be seen better.

DESCRIPTION OF A PREFERRED EMBODIMENT

Figure 1:
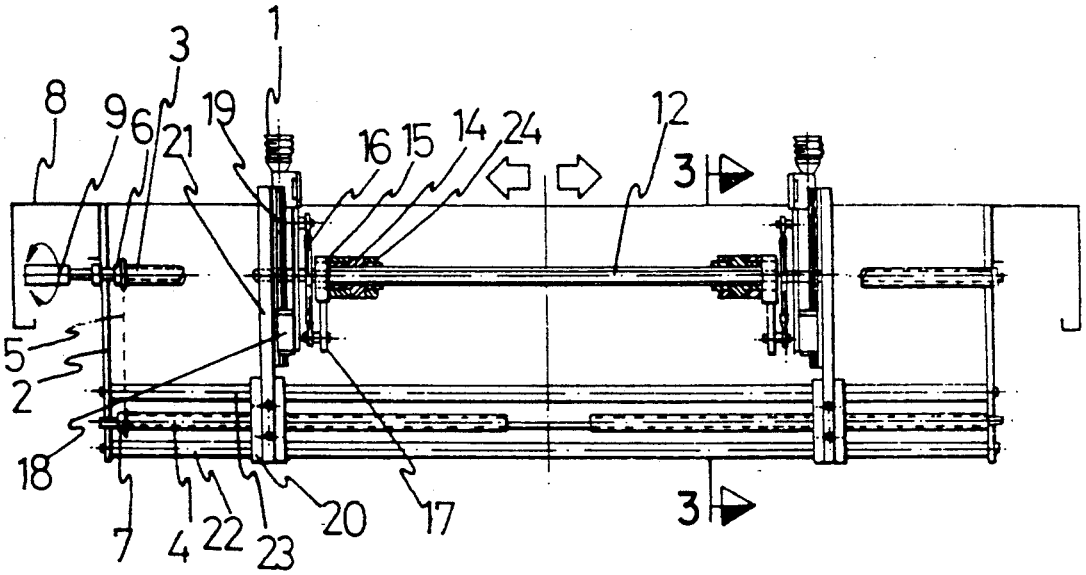
FIG. 1 shows a raised longitudinal view of the adjustable mechanism for feeding cardboard sheets.
Figure 2:
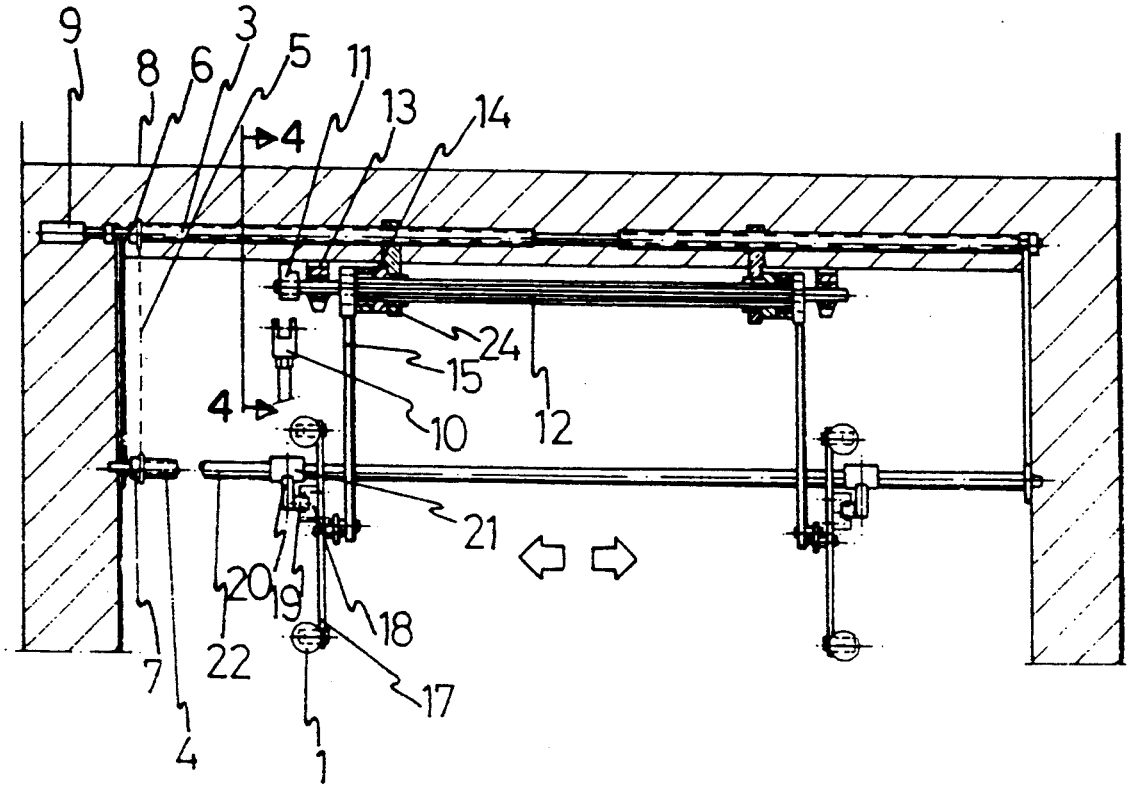
FIG. 2 represents the same mechanism in a plan view.
Figure 3:
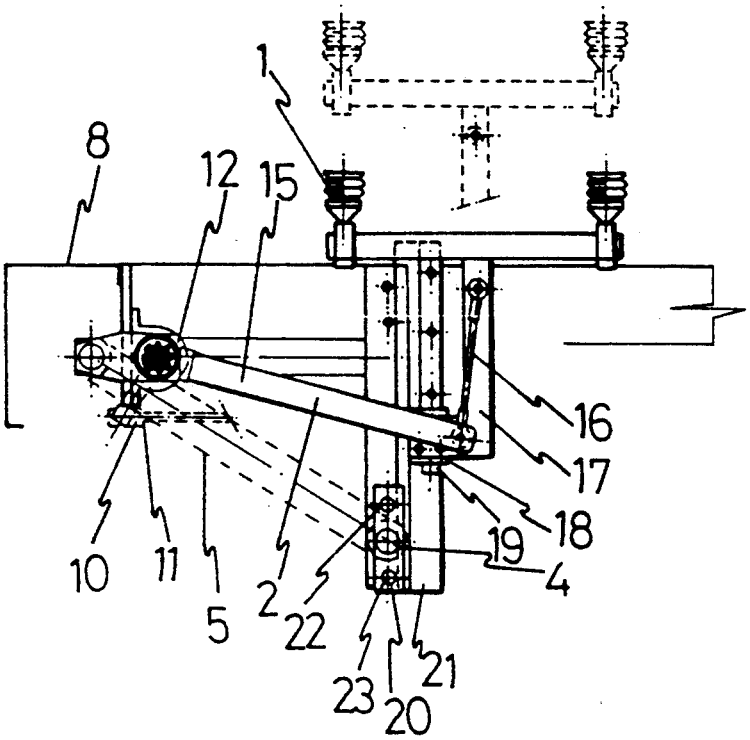
FIG. 3. shows a section of the cited mechanism according to A—A' of FIG. 1.
Figure 4:
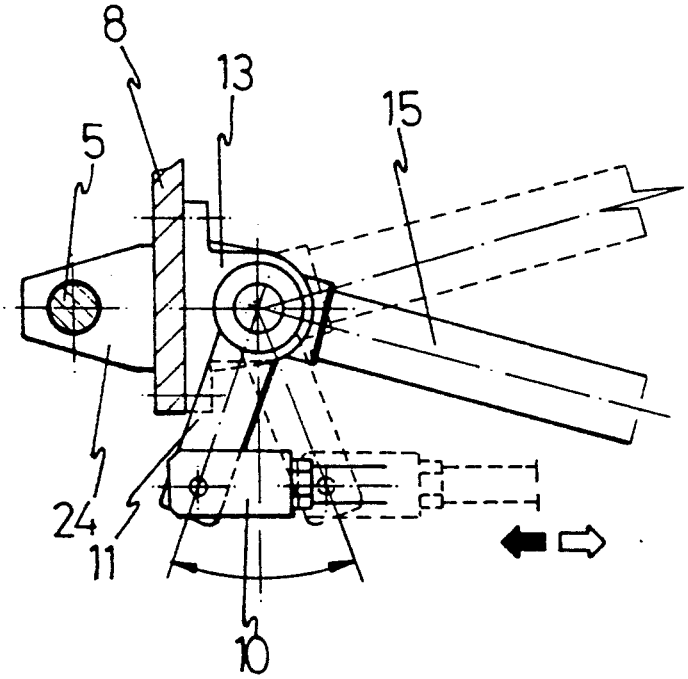
FIG. 4 shows a detail of the cited mechanism, on a larger scale, according to section B—B', of FIG. 2.
Figure 5:
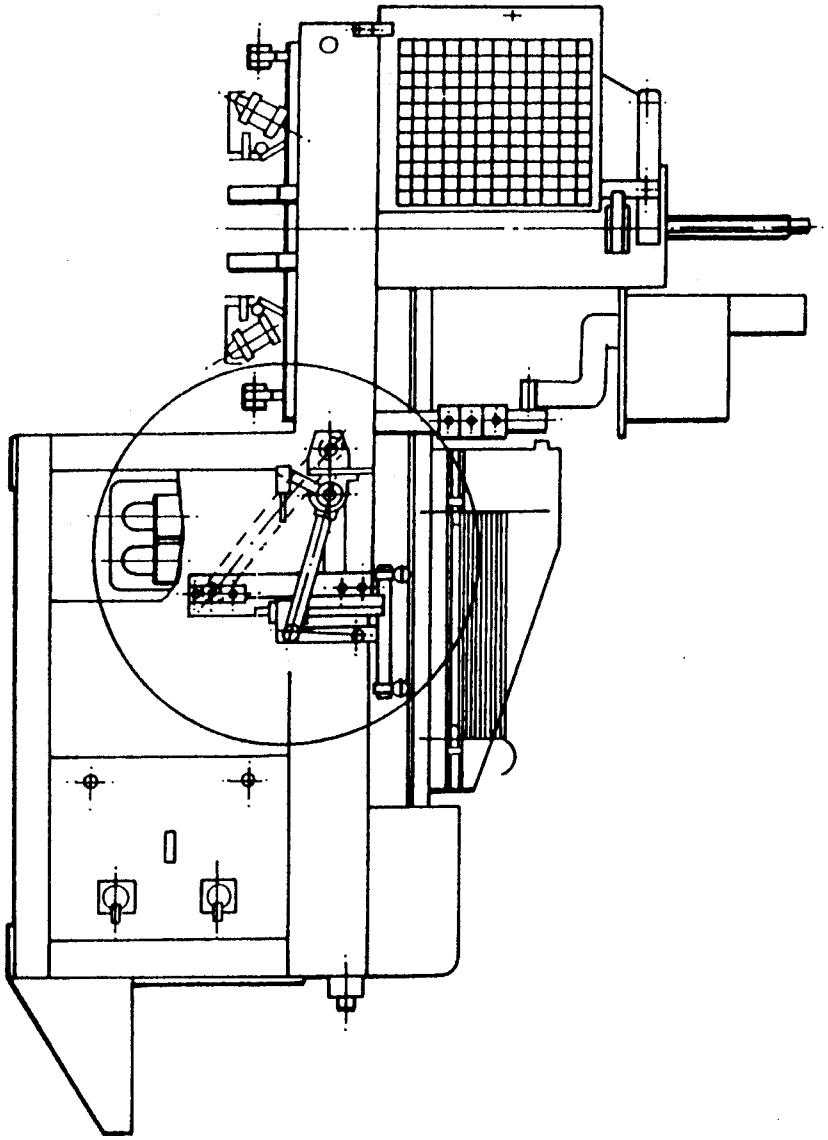
FIG. 5 shows schematically the longitudinal raised view of the cardboard box assembly machine. The sheet feed mechanism, according to the invention, is shown within a circle (seen from the side) in coincidence with described FIG. 3.
Figure 6:
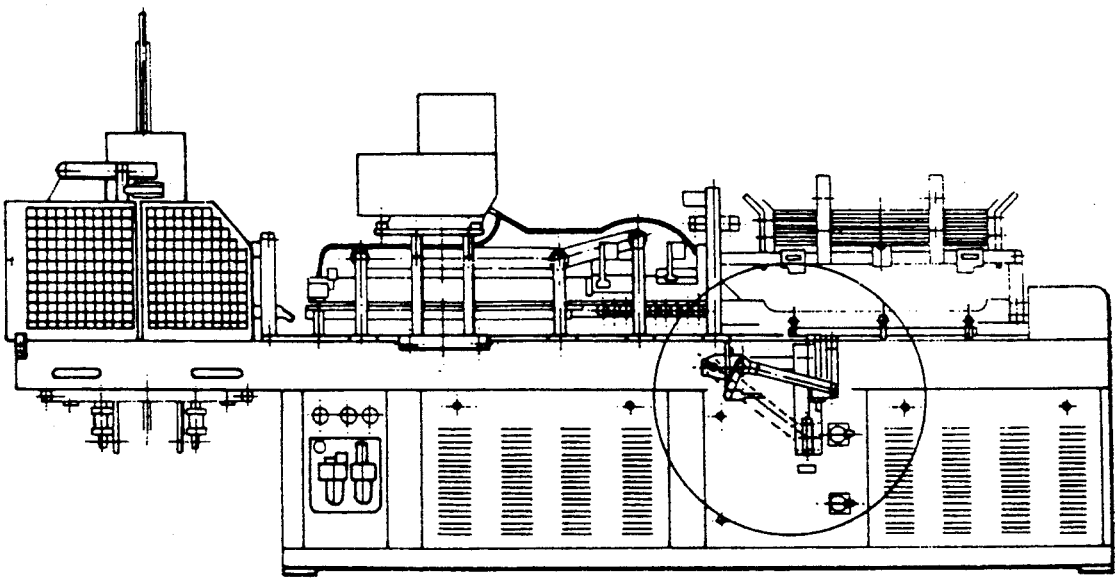
FIGS. 6 and 7 represent other assembly machines, with schematic side views, where the conventional vacuum suction pad system has incorporated the feed mechanism of the invention, seen in the sam way as FIG. 5, in a side view within a cicle for easy placement thereof.
Figure 7:
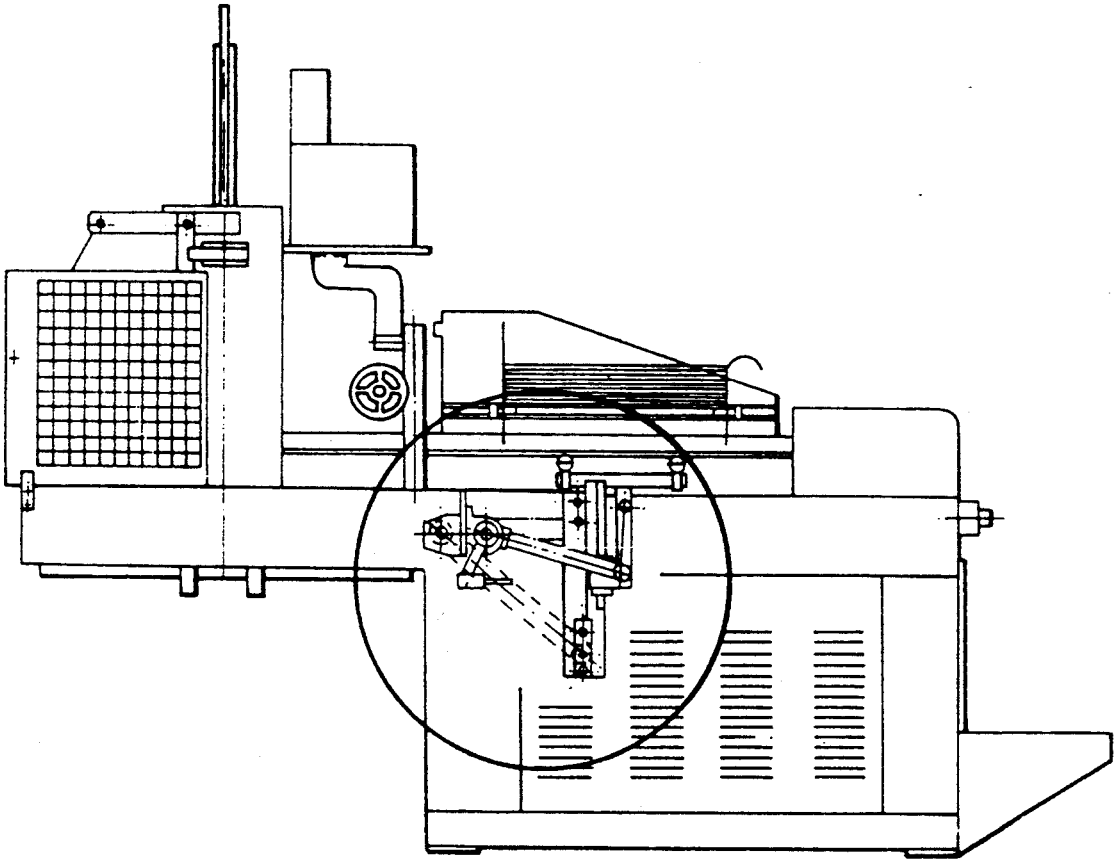
Figure 8:
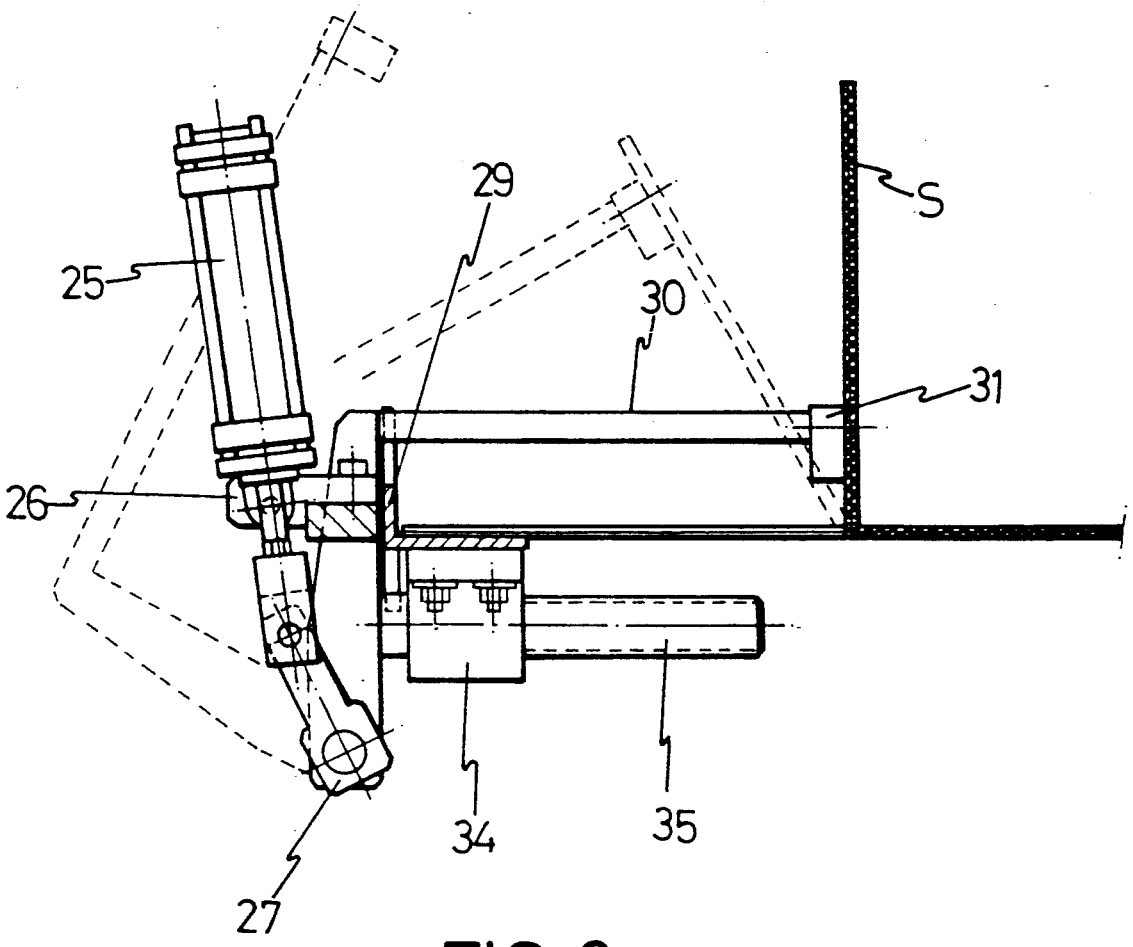
FIG. 8 shows the lap lifitng device, seen from the side, in the function of lifting up to 90° the laps of one side of a sheet with which a cardboard box is formed, seen according to section A-V with regard to FIG. 9.
Figure 9:
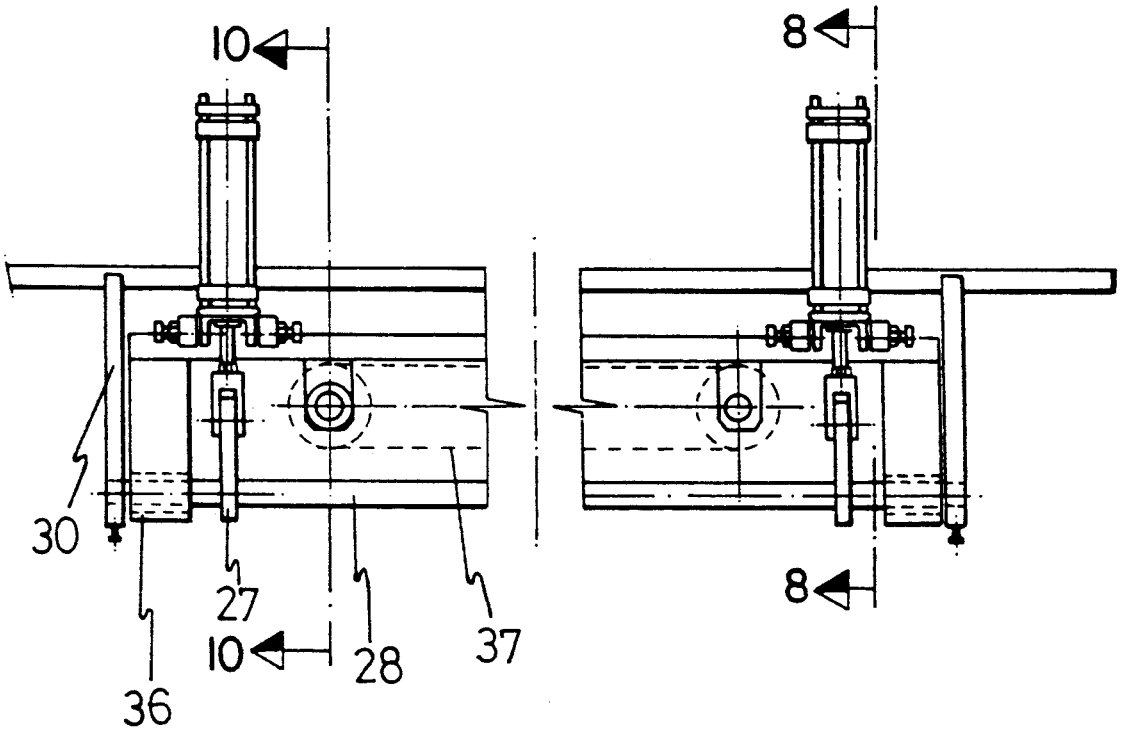
FIG. 9 represents the front raised view of the lap lifting device.
Figure 10:
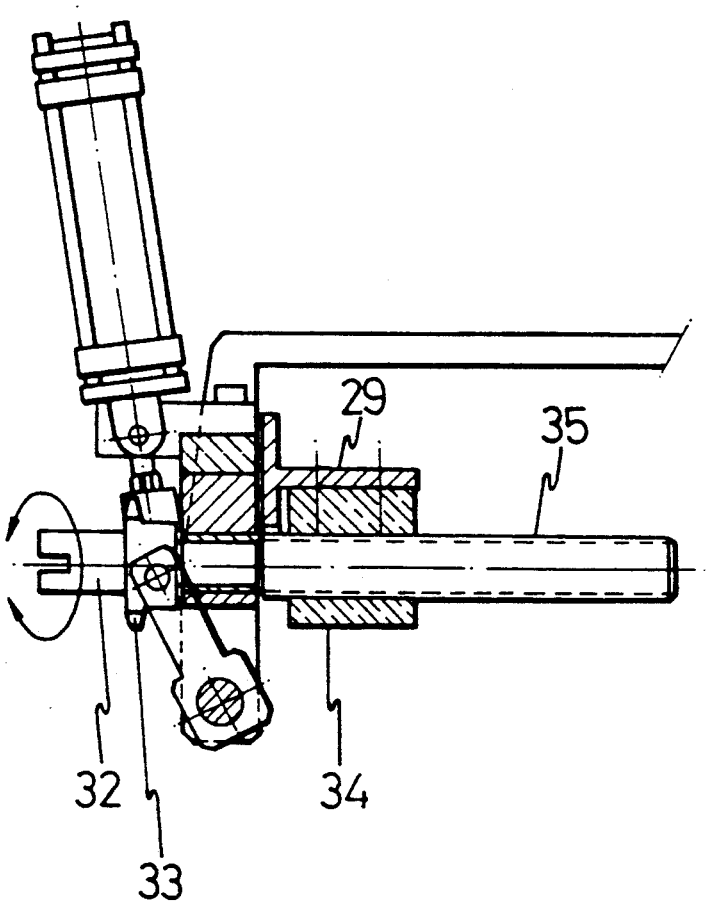
FIG. 10 shows a section sectioned by C-D, according to FIG. 9, showing the adjustment system which makes it possible to approximate or separate the lifting device, according to the format or dimensions of the laps.
Figure 11:
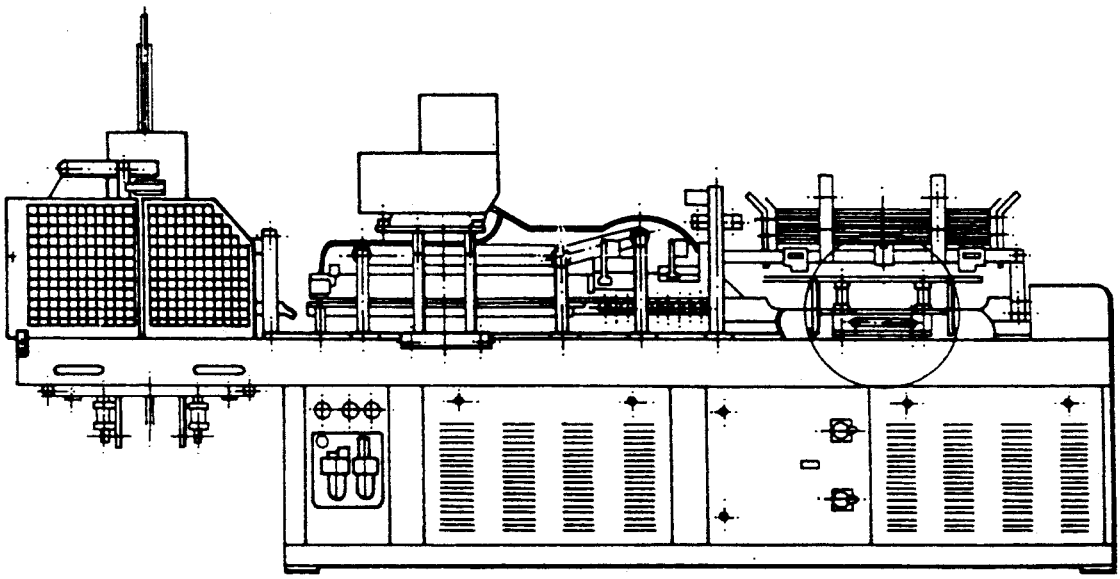
FIG. 11 shows the front raised view of a box assembly machine, such as FIG. 6, showed enclosed in a circule the location of the lap lifting device, object of the invention.

On the grounds of the filed drawings and referring in the first place to the constitution of the adjustable mechanism to feed cardboard sheets, it can be seen that it comprises two groups of suction pads (1), with the mechanical operation elements of each group resting on supports (2) and coupled upon the twin sections of contrary thread, of two parallel spindles (3) and (4) that are connected together by a chain transmission and piniones (6) and (7), mounted on said spindles, which rest on the chassis (8) of the device. Both spindles rotate in the same direction driven by a wheel or handle placed in the coupling (9) that one of them is provided with. The rotation of the spindles, in one direction or the other determines the linear displacement of the elements that connect them with the support and drive means of the vacuum suction pad groups (1.)

The operating means consist of an eccentric rod (10) that drives an eccentric articulated rod (11) and gives oscillating rotation movement to a striated rod (12) resting on supports (13) with bearings upon whose striated rod a striated bucket (14) is mounted and which rotates with the rod (12) and has coupled the end of an oscillation connecting rod-lever (15) connected by a connecting rod (16) with the arm (17) support of the rods, to whose bar it is connected by means of a slipper (18), that moves along a linear vertical guide (19) resting on the support (20.)

This vertical guide support is solidly connected to a piece (21) mounted on the bottom spindle and resting on the parallel guide bars (22) and 23.)

The striated buckets (14) that turn with the bar (12) are connected with the top spindle (3) by means of a binding nut (24.)

The linear approach or separation displacement of the suction pad groups (1) and (2) is done by rotation of the top spindle (3) and simultaneously, due to the chain transmission (5) and pinions (6) and (7) by the bottom spindle (4), the first one guided by the striated bar (12) and the second one by the parallel bars (22) and (23.)

In view of the cited drawings, it is understood that the adjustable cardboard sheet feed mechanism can adjust the approach or separation of the vacuum suction pad groups, irrespective of the oscillation movement produced, given that the transmission of this movement is done upon a fixed point of the striated shaft, therefore, without interfering in the operation of the feeding of the cardboard sheets. The operation simplicity stands out for adjustment of the separation or approach of the suction pad groups, since it is only necessary to adapt to the coupling (9) a handle or wheel and make the spindles (3) and (4) turn.

Now going on to the lap lifting device, in the corresponding figures of the drawings, one can see that it comprises pneumatic cylinders (25), articulatedly resting on the support (26) and whose ram is connected by a connecting rod (27) and corresponding rotational axes (28) with the arms (30) that have an angular shape and sustain the strip (31) destined to lift the laps (S) of the box.

The cited support (26) is mounted on a longitudinal bracket (29), to which some nuts (34) are joined and the latter are threaded to the spindles (35), to whose end a wheel or handled can be adapted for operation thereof. The rotation of these spindles is done simultaneously by a chain transmission, upon the pinions (33.)

The support (26) has a vertical bottom extension (36) on which the rotation axis (28) of the arms (30) of the strip (31) rest.

I claim:

1. An improvement in machines for assembling cardboard boxes from cardboard sheets having flaps, comprising:

means for feeding the cardboard sheets;

means for lifting the flaps of the sheets when forming the boxes, said feeding means comprising at least two vacuum suction pads for moving each sheet from a stack of sheets to a folding area, means for adjusting the distance between said suction pads, said adjusting means comprising a pair of parallel threaded spindles;

means for rotating said spindles;

a chain connecting said spindles, such that said spindles rotate simultaneously;

said adjusting means further comprising:

a rotatable striated shaft generally parallel to said spindles and connected to a first of said spindles by at least a first connecting means, said first connecting means being connected to said shaft and to said first spindle such that when said spindles are rotated said first connecting means travels along said first of said spindles and slides on said shaft;

at least one arm slidably engaged to said shaft and fixed to said first connecting means such that when said spindles are rotated, said first connecting means moves along said first spindle and said shaft and such that when said shaft rotates, said arm is caused to tilt simultaneously;

means for supporting said suction cups connected to said arm such that when said arm tilts, said support means moves in a generally vertical direction.

2. An improvement as in claim 1, further comprising a chassis, said striated shaft being supported by bearings mounted to said chassis, said first spindle being connected to said striated shaft by a nut mounted on the first spindle and a bucket mounted on the striated shaft, said bucket being connected to said arm.

3. An improvement as in claim 1, further comprising two bars and two support pieces, said two bars being mounted parallel to the second of said spindles, said two support pieces being slidably engaged to said bars and connected to said second of said spindles such that rotation of the second spindle causes said support pieces to travel on said bars, each of said support pieces being connected to a slipper and a vertical linear guide for supporting at least one of said suction pads for vertical movement.

4. An improvement as in claim 1, further comprising a flap lifting device, said flap lifting device comprising:

a support;

two vertical pneumatic cylinders with pistons mounted on said support;

a shaft connected to said pistons such that actuation of said cylinders and pistons causes rotation of said shaft;

two angled arms having proximal and distal ends, said arms each mounted on said shaft at its proximal end;

a strip mounted on said angled arms at said distal ends, such that when said shaft is rotated, said angled arms will rotate and move said strip to a first position in which said strip contacts one of the flaps of one of the sheets and pushes said flap to a position substantially perpendicular to said sheet;

and further comprising means for adjusting the positioning of said strip with respect to said sheet, said strip adjusting means having a bracket connected to said support and a nut mounted on a third threaded spindle such that when said third spindle is rotated, said bracket and said support will move in relation to said sheets.

* * * * *